US005087162A

United States Patent [19]

Basler

[11] Patent Number: 5,087,162

[45] Date of Patent: Feb. 11, 1992

[54] PROCESS FOR BINDING PAMPHLETS AND THE LIKE

[75] Inventor: Guenter Basler, Darmstadt, Fed. Rep. of Germany

[73] Assignee: Hollmann GmbH, Fed. Rep. of Germany

[21] Appl. No.: 297,566

[22] Filed: Jan. 17, 1989

[51] Int. Cl.[5] ..... B42C 11/00

[52] U.S. Cl. ..... 412/4; 412/1; 412/8

[58] Field of Search ..... 83/365, 371; 412/4, 412/16, 19, 11, 8, 6, 5, 33, 37, 901, 1

[56] References Cited

U.S. PATENT DOCUMENTS

| | | | |
|---|---|---|---|
| 1,811,201 | 6/1931 | Kleineberg | 412/19 |
| 2,762,066 | 9/1956 | Meyer | 412/4 |
| 4,221,144 | 9/1980 | Diesch et al. | 83/365 X |
| 4,556,353 | 12/1985 | Ehlermann | 412/19 X |
| 4,781,090 | 11/1988 | Feldkamper et al. | 83/365 |

FOREIGN PATENT DOCUMENTS

| | | | |
|---|---|---|---|
| 1093775 | 12/1960 | Fed. Rep. of Germany | 412/4 |
| 2815143 | 10/1978 | Fed. Rep. of Germany | 412/11 |
| 1961040 | 2/1979 | Fed. Rep. of Germany | 412/901 |
| 2502547 | 10/1982 | France | 412/11 |
| 0098377 | 6/1983 | Japan | 412/901 |
| 1362665 | 12/1987 | U.S.S.R. | 412/19 |
| 2144080 | 2/1985 | United Kingdom | 412/8 |

*Primary Examiner*—Frank T. Yost
*Assistant Examiner*—Hwei-Siu Payer
*Attorney, Agent, or Firm*—Fulbright & Jaworski

[57] ABSTRACT

A production sequence for binding pamphlets, catalogs, books and the like. In the process, a printed spine fold provided with optically readable control markings is cut from its storage roll and transported to the fold bonding station. There, under electronic control and in a transverse position, the spine fold is combined with a gathered block of pages and front and back covers. The spine fold adhering to the covers is folded around and pressed onto the two adhesive coated folding edges of the covers and the back of the block. The uncut spine slip folds are supplied in the form of a continuous strip on a roll. They are stored parallel to each other and to the axle of the roll, and printed with text and control markings. This permits a number of spine slip folds to be simply printed in a continuous strip, wound on a roll and stored. The control code printed on every spine contains information on the width of the spine. The control code is scanned by a sensing device that is connected to the controlling means for a cutting device that then cuts the spine accordingly. The cutting table of the cutting device is located under the belt on which the adhesive coated spine is transported. As the spine fold is cut from the roll, it is blown against the back of the block that has been previously provided with a front and back cover.

18 Claims, 1 Drawing Sheet

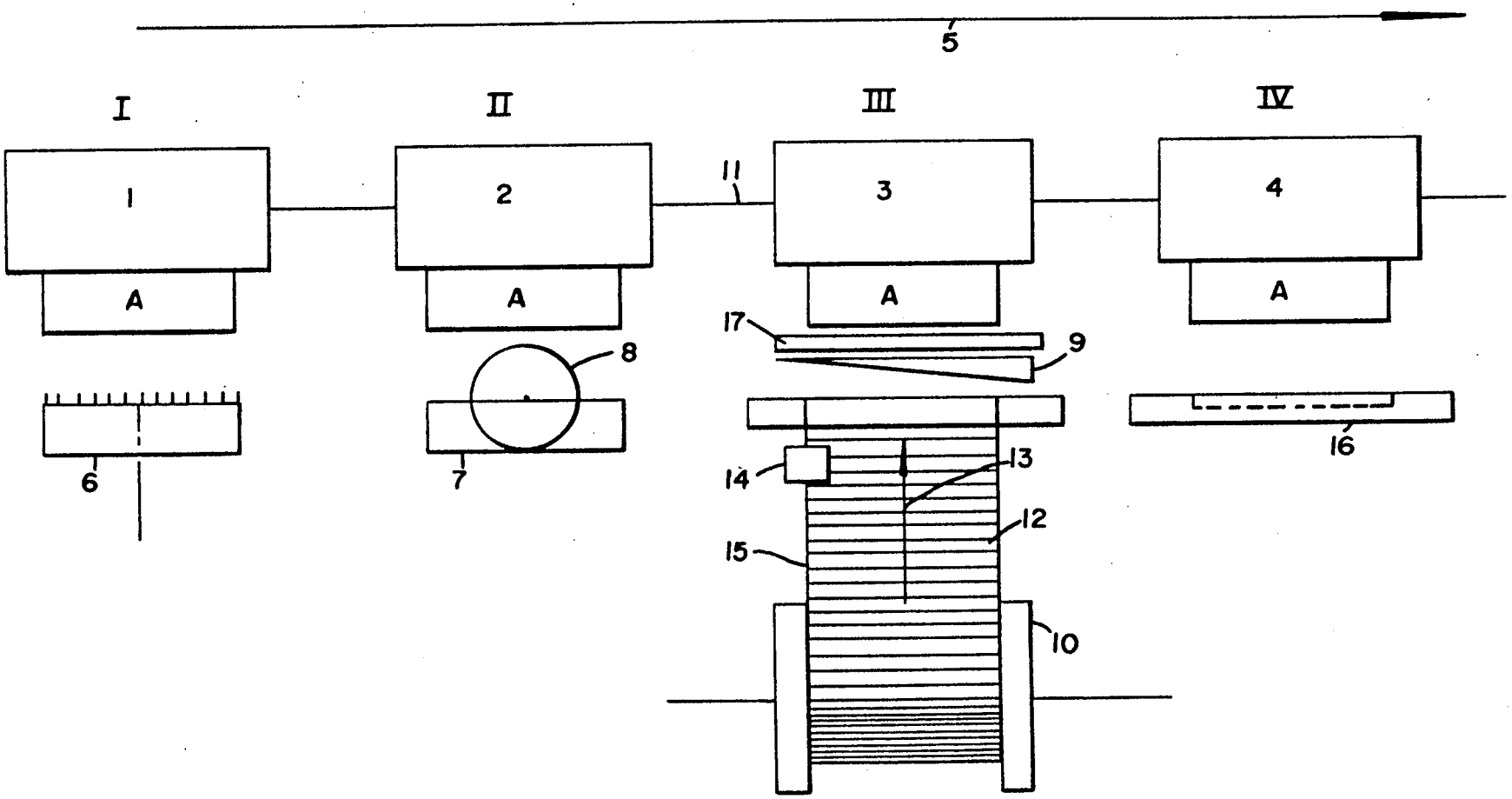
I
II
III
IV
1
2
3
4
A
A
A
A
5
6
7
8
9
10
11
12
13
14
15
16
17

PROCESS FOR BINDING PAMPHLETS AND THE LIKE

BACKGROUND OF THE INVENTION

1. Field of the Invention

The field of the invention relates to a process for binding pamphlets, catalogs and similar bound products made from folded printed sheets. These products are normally made by means of an adhesive binding apparatus, wherein the printed sheets are combined in a block, the front and back sides of the cover are deposited, the cover edges and the back of the block are coated with an adhesive and a spine fold is brought to the block and bonded to it from a spine fold station associated with the adhesive binding apparatus.

2. Description of the Related Technology

In recent years, the use and importance of publications such as pamphlets has dramatically increased. To keep pace with this increase, methods for rapid, inexpensive production of large numbers of high quality publications are necessary.

A common process for binding involves numerous distinct operations. It begins by inserting folded or rotation folded sheets into the sheet magazine of a gathering machine that has been previously set up. The gathering machine combines the sheets into a block. A special machine, in a separate operation, brings together cover sheets and an unprinted longitudinal spine, adhesively binds them together, and presses them. The assembled cover then goes to a spine printing machine, it is then dried and transported to a gathering machine. The gathering machine combines one side of the cover with the block, and an adhesive machine glues them together. A second gathering machine is used to assemble the block and the other cover.

This process requires a series of steps of a highly different nature. It is necessary to carry out the gathering of the front and back side of the cover on separate machines. The adhesive bonding and drying of the spine fold is done separately. A further working step is transporting the product to a print shop merely to print the spine fold on the future back side and on one edge of the back side of the cover.

Printing the covers creates several problems which can be resolved only at great expense. The front and back sides of the cover do not meet; they are spaced apart by the glued on longitudinal spine at a distance corresponding to the block to be inserted later. This forces the printing process to be carried out on surfaces with differing areas: one surface is the size of only one cover, and the other surface is the size of the other cover and the spine.

When printing the spine and the covers together, most of the ink is rolled around the roll if only a small quantity of ink is deposited in the printing process. The ink therefore runs "dead" on the rolls. As a result, the ink emulsifies, and its drying properties change in an unfavorable direction, i.e. the drying time of the ink is considerably increased. These problems were resolved at considerable cost.

The problems relative to the double transport were not overcome. Rather, it is necessary to use especially developed pallets to transport the covers.

In a sequence of processing steps for the manufacture of a product, the inherent errors are additive; they may be reduced by a commensurate effort, but cannot be excluded.

In the process of gathering and bonding the front and back parts of the cover with the spine fold, it is necessary to exactly coordinate the parts relative to each other. The printing process requires a further appropriate alignment. Finally, a third alignment must be carried out during the adhesive bonding of the cover to the block. There are therefore three independent sources of defects in alignment. Any one of these defects could result in a very poor quality product or even make it unusable.

DE-AS 1 093 775 discloses a machine for the bonding of endless printed strips to books. For an adhesive binding apparatus with a high hourly output these strips are not suitable, as frequent replacement of the empty rolls is necessary, leading to long downtimes for the entire installation.

SUMMARY OF THE INVENTION

It is an object of this invention to provide a production sequence for binding pamphlets, catalogs, books and the like. The previously discussed sequences and sources of defects have been eliminated. The present invention is a manufacturing process that may be carried out on one production line, so that the numerous transportation problems are eliminated entirely and the printing problems that were previously resolved only with great difficulty, are completely avoided.

According to the invention, the problems of previous processes are avoided in the following manner. A printed spine fold provided with optically readable control markings is cut from its storage roll in the folding station and transported to the spine fold bonding station. There, under electronic control and in a transverse position, the spine fold is combined with the gathered block and the front and back covers. The spine fold adhering to the covers is folded around and pressed onto the two adhesive coated folding edges of the covers and the back of the block.

According to the invention, the uncut spine slip folds are supplied in the form of a continuous strip on a roll. At the folding station, they are stored parallel to each other and to the axle of the roll, and printed with text and control markings. This permits a large number of spine slip folds to be printed in a continuous strip in a simple manner, wound on a roll and stored. Thus, instead of transporting the spine folds that are connected to covers to the printing process, printing is carried out on a single storage roll for a large number of spine folds. This results in only a one-time setting for all of the number of folds to be printed, and eliminates a defect source which in the present state of the art could appear during every print run.

The control code printed, according to the invention, on every spine contains information on the width of the spine. The control code is scanned by an appropriate sensing device, connected to the controlling means for a cutting device that then cuts the spine accordingly.

The cutting table for the cutting device is located advantageously under the belt on which the adhesive coated spine is transported. As the spine fold is cut from the roll, it is blown against the back of the block that has been previously provided with a front and back cover.

In this manner, all of the problems related to the printing according to the state of the art of spine folds already bonded to the front and back side of the cover are eliminated.

The spine fold, in one embodiment, exhibits a printable fabric with a high tear resistance.

The invention will become more apparent from the description with reference to the drawing.

BRIEF DESCRIPTION OF THE DRAWINGS

The FIGURE shows a schematic of processing stations I–IV. Station I is the back processing station where the back of the book block is processed.

Station II is the adhesive bonding station where adhesive is applied for the spine fold.

Station III is the bonding station where the spine fold is applied to the back of the block.

Station IV is the back shaping station where the spine fold is pressed onto the back of the block and the edges of the covers.

DETAILED DESCRIPTION OF THE PREFERRED EMBODIMENT

The drawing shows schematically an adhesive bonding apparatus with different processing stations. The gathering stations preceding the processing stations are not shown. The processing stations I–IV are traversed by tongs on wheels 1–4, which are connected with an endless conveyor belt 11. The direction of the processing run is indicated by the arrow 5. In the back processing station I the back of block A is processed by a milling machine 6.

The book block then passes through the adhesive bonding station II, which comprises a glue pot 7 and an applicator roll 8 immersed into the glue. The roll 8 transfers the glue to the back of block A. By means of laterally placed smaller rolls, not shown, a narrow strip on the back of either side of block A is also wetted with the adhesive for the lateral attachment of the spine.

Bonding station III is equipped with the cutting device 9. This device may be in the form of a longitudinally displaceable blade. Laterally to bonding station III, a roll 10 is rotatably supported. This roll contains the spine fold 12 as a continuous, printed strip moving in the direction of the arrow 13. Each of the spine folds 12 printed in the axial direction of the roll 10 is provided with a control code or mark 15, which is scanned by the photocell 14. In this embodiment, the photocell 14 emits a control signal for the actuation for the advance mechanism, of the spine strip 12 and the blade 9, so that the exact width of the spine is attained. A spine fold 12 cut by the blade 9 from the strip under the back of the block to which the covers have been previously added, is blown against the adhesive coated back A by the blowing means 17.

The back A with the spine 12 blown onto it, then passes through the back shaping station IV, in which the pressing of the back and the lateral erection of the spine fold and its pressing are carried out by the back-shaping apparatus 16.

The source of error prevailing in the state of the art relative to the alignment is eliminated by the invention by the fact that the printed elements are detected optically and positioned electronically in a continuous operation. This results in precise control. The use of a preprinted spine fold having a code mark to regulate the alignment reduces such problems to zero.

The invention completely eliminates the transportation problems and in particular the time dependence related to it, as the spine folds may be printed and stored in one process.

I claim:

1. A process for binding folded sheets using an adhesive binding apparatus which comprises the steps of:

gathering said sheets into a block having a top face, a bottom face and edges forming at least a front face and back face;

placing covers on said top face and said bottom face;

coating the back face of said block and adjacent portions of said top cover and said bottom cover with an adhesive;

taking a pre-printed spine fold exhibiting optically readable control markings from a magazine;

cutting said spine fold;

transporting said spine fold to a bonding station; and combining said spine fold with said adhesive coated back face, folding said spine fold around said adjacent adhesive coated portions of said covers, and pressing said spine fold onto said adhesive coated back face and said adhesive coated cover portions; said steps of cutting, transporting and combining of said spine fold being performed in accordance with said pre-printed optically readable control marking.

2. A process according to claim 1 wherein said steps of coating, taking and combining are automated.

3. A process according to claim 1, further comprising the step of:

determining the width of said spine fold by scanning said control markings printed on said spine fold by a photocell connected to a control cutting device.

4. A process according to claim 3 wherein said steps of coating, taking and combining are automated.

5. A process according to claim 3 wherein said step of cutting further comprises cutting said spine fold on a cutting table located under a path traveled by said adhesive coated back, and said step of combining further comprises at least blowing said spine fold onto said adhesive coated back.

6. A process according to claim 5 wherein said steps of coating, taking and combining are automated.

7. Process according to claim 5, wherein further comprising the steps of :

transporting said block having said covers and said spine fold adhesively attached to a back shaping station, and pressing said back.

8. A process according to claim 7 wherein said steps of coating, taking and combining are automated.

9. A process according to claim 1 wherein said step of cutting further comprises cutting said spine fold on a cutting table located under a path traveled by said adhesive coated back, and said step of combining further comprises at least blowing said spine fold onto said adhesive coated back.

10. A process according to claim 9 wherein said steps of coating, taking and combining are automated.

11. Process according to claim 9, further comprising the steps of:

transporting said block having said covers and said spine fold adhesively attached to a back shaping station, and pressing said back.

12. A process according to claim 11 wherein said steps of coating, taking and combining are automated.

13. A process according to claim 1, wherein said step of taking comprises the step of unrolling said spine fold from a continuous strip of spine folds wound onto a roll exhibiting pre-printed text and optically readable control markings, aligned parallel to each other and an axle of said roll.

14. A process according to claim 13 wherein said steps of coating, taking and combining are automated.

15. A process according to claim 13 wherein said step of cutting further comprises cutting said spine fold on a cutting table located under a path traveled by said adhesive coated back, and said step of combining further comprises at least blowing said spine fold onto said adhesive coated back.

16. A process according to claim 15 wherein said steps of coating, taking and combining are automated.

17. Process according to claim 15, further comprising the steps of:

transporting said block having said covers and said spine fold adhesively attached to a back shaping station, and pressing said back.

18. A process according to claim 17 wherein said steps of coating, taking and combining are automated.

* * * * *